United States Patent [19]

Wang

[11] Patent Number: 5,001,997

[45] Date of Patent: Mar. 26, 1991

[54] SEWING MECHANISM FOR QUILTING MACHINE

[75] Inventor: Ching W. Wang, Taiwan, China

[73] Assignee: Kennoth G. Gammill, West Plains, Mo.

[21] Appl. No.: 496,980

[22] Filed: Mar. 21, 1990

[51] Int. Cl.[5] ..... D05B 47/04; D05B 29/06

[52] U.S. Cl. ..... 112/255; 112/241; 112/235; 112/320; 112/162

[58] Field of Search ..... 112/168, 255, 103, 465, 112/225, 259, 224, 223, 254, 463, 462, 464, 117, 118, 221, 162, 163, 164, 443, 449, 453, 459, 229, 233, 234, 236, 250, 249, 310, 311, 302, 235, 320, 119, 237, 238, 239, 240, 319, 321, 467, 448, 262.3, 111, 176, 241, 253

[56] References Cited

U.S. PATENT DOCUMENTS

| | | | |
|---|---|---|---|
| 381,798 | 4/1888 | Koch . | |
| 448,253 | 3/1891 | Palmer . | |
| 1,016,488 | 2/1912 | Grieb | 112/162 |
| 1,194,254 | 8/1916 | Sumner . | |
| 1,534,264 | 4/1925 | Hanson . | |
| 1,675,609 | 7/1928 | Kelley . | |
| 2,075,537 | 3/1937 | Moreland | 112/249 |
| 2,157,373 | 5/1939 | Weis | 112/162 |
| 2,158,197 | 5/1939 | Pikul | 112/241 |
| 2,191,046 | 2/1940 | Liesler . | |
| 2,281,308 | 4/1942 | Johnson . | |
| 2,289,902 | 7/1942 | Christensen | 112/235 |
| 2,413,277 | 12/1946 | Hilier . | |
| 2,652,017 | 9/1953 | Hohmann . | |
| 3,099,236 | 7/1963 | Taylor | 112/255 |
| 3,633,525 | 1/1972 | Landoni . | |
| 3,749,037 | 7/1973 | Cash . | |
| 3,960,095 | 6/1976 | Story . | |
| 4,006,696 | 2/1977 | Robertson . | |
| 4,148,268 | 4/1979 | Schmidt et al. . | |
| 4,192,241 | 3/1980 | Reed et al. . | |
| 4,300,465 | 11/1981 | Tsuboi . | |
| 4,452,156 | 6/1984 | Teetz et al. . | |
| 4,501,208 | 2/1985 | Landoni . | |
| 4,508,043 | 4/1985 | Vollmar . | |
| 4,550,671 | 11/1985 | Dusch . | |
| 4,590,877 | 5/1986 | Schwarzberger | 112/262.3 |
| 4,651,658 | 3/1987 | Vogel . | |
| 4,702,185 | 10/1987 | Hanyu et al. | 112/254 |
| 4,704,975 | 11/1987 | Hara et al. | 112/238 |
| 4,867,084 | 9/1989 | Braun | 112/221 |

FOREIGN PATENT DOCUMENTS

| | | | |
|---|---|---|---|
| 1100290 | 5/1986 | Japan | 112/302 |
| 3296783 | 12/1988 | Japan | 112/320 |
| 2071172 | 9/1981 | United Kingdom | 112/163 |
| 2174421 | 11/1986 | United Kingdom | 112/176 |

*Primary Examiner*—Werner H. Schroeder
*Assistant Examiner*—Sullivan C. Prak
*Attorney, Agent, or Firm*—Litman, McMahon & Brown

[57] ABSTRACT

A sewing apparatus for use on a quilting machine having an intermittent tension mechanism and a hopping presser foot mechanism cooperating with eccentric cams located on the main drive shaft of the sewing apparatus.

The intermittent tension mechanism includes an eccentric cam having an outer surface adapted to abut a cam follower which engages thread holding tension disks that are biased together by action of a spring. Pressure between the disks is increased during the final tightening of the stitch due to the reciprocating motion of the cam follower.

The hopping presser foot mechanism includes a rocking bar pivotally connected at one end to a reciprocating arm and slidingly and pivotally connected at the other end to a presser foot bar. A ball and race mechanism pivotally connects the rocking bar with the reciprocating arm. The arm reciprocates due to action of the eccentric cam.

13 Claims, 3 Drawing Sheets

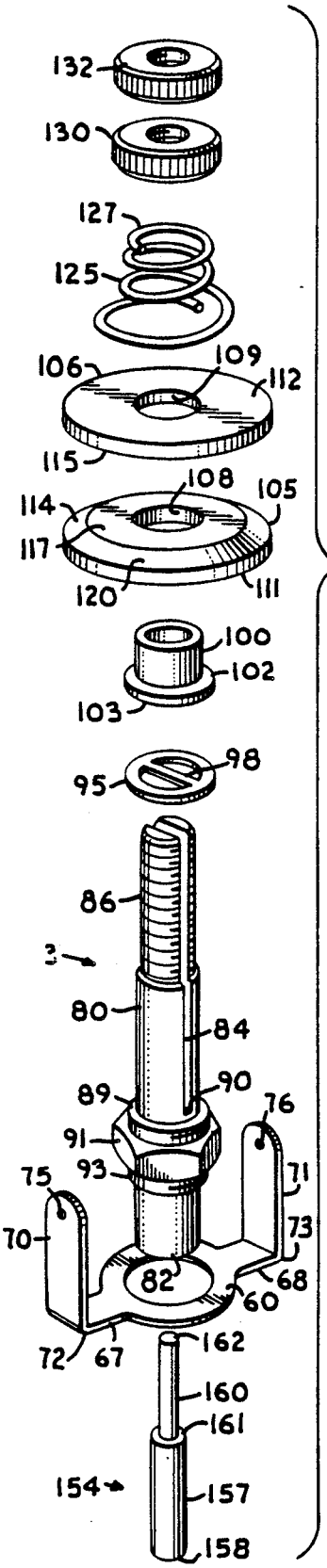
Fig.7.
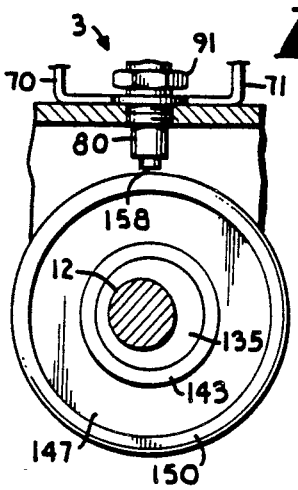
Fig.5.
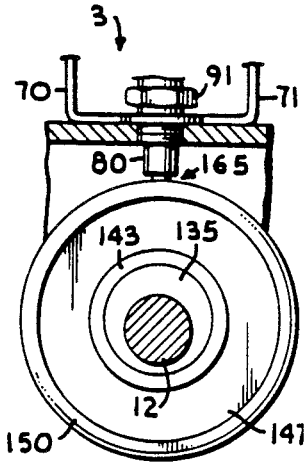
Fig.6.
Fig.8.
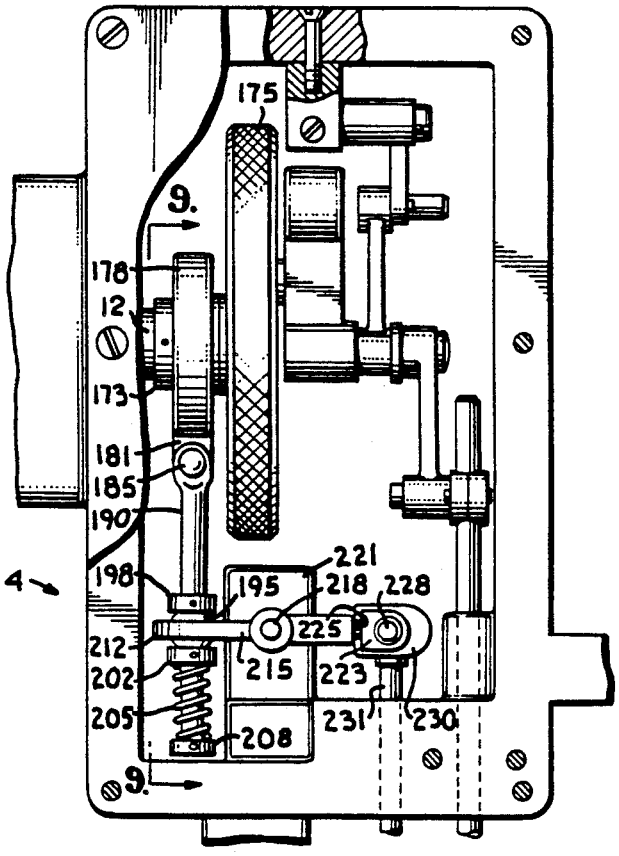

Fig.9.
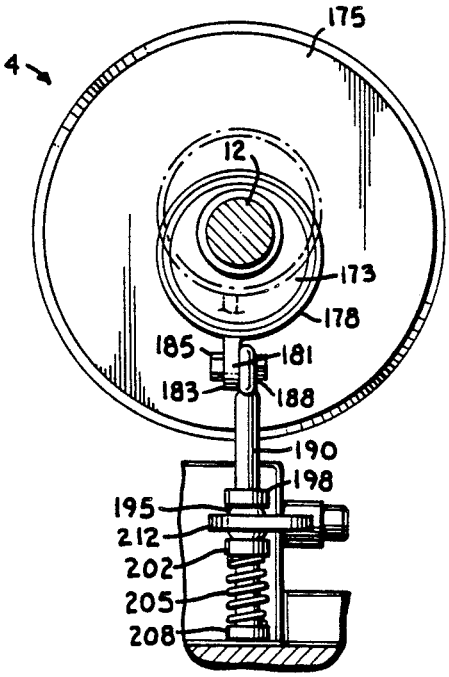
Fig.10.
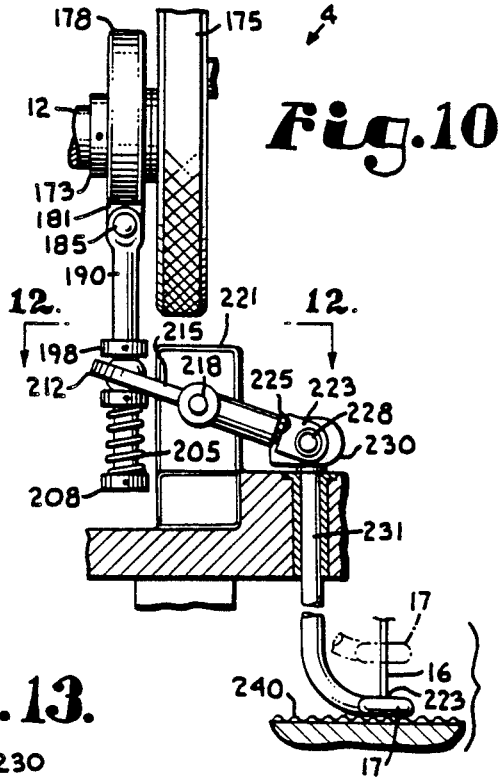
Fig.13.
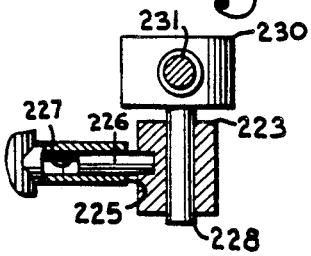
Fig.12.
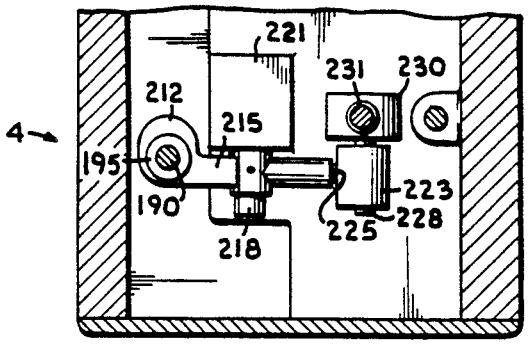
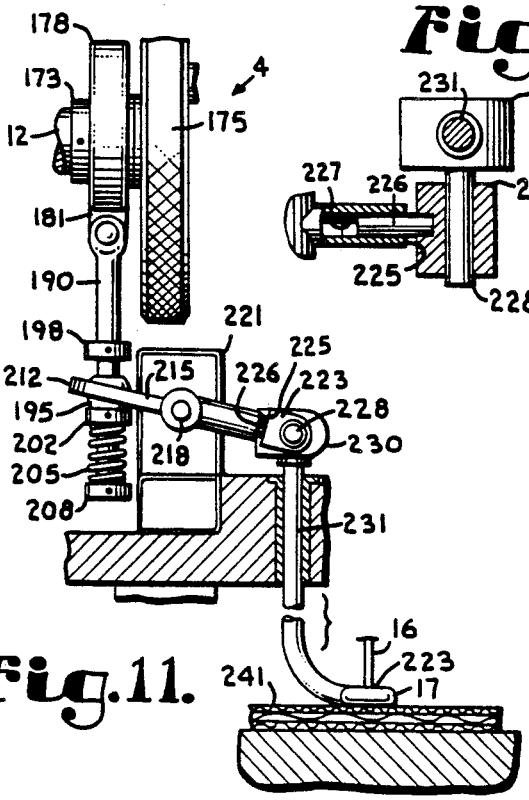
Fig.11.

SEWING MECHANISM FOR QUILTING MACHINE

FIELD OF THE INVENTION

The present invention relates to sewing machines used to make quilted fabrics and, more particularly, to thread tensioning mechanisms and fabric controlling mechanisms enabling the sewing machines to efficiently sew both thick and thin material widths in all directions.

BACKGROUND OF THE INVENTION

Many types of machines have been devised for sewing quilts, comforters and the like. Many conventional sewing machines may be adapted to quilting by placing them on rollers or tracks on a quilting frame so that the operator may move a needle of the sewing machine in a pattern while keeping the quilting materials stationary.

If a quilting apparatus is equipped with a conventional sewing machine without modification, problems are encountered because of the thickness of the material to be quilted. In particular, quilts incorporate at least three material layers: two outer pieces and a filler material inbetween. The filler material may be thin or thick, depending upon the final use of the quilted product. Therefore, a problem often experienced is the inability of the traditional presser foot utilized on most sewing machines to adjust to different quilt thicknesses, causing erratic feeding of the material and thus unwanted variable stitch lengths.

Furthermore, such a conventional presser foot normally places constant pressure against the material and tends to bunch or gather material together when used in a quilting process where stitching is rarely in a straight line.

Other problems resulting from using a conventional sewing machine as part of a quilting machine are associated with the tension mechanism. Because quilts are usually fairly large and require a substantial length of stitching thread, it is advantageous to use a large bobbin in order to reduce the number of bobbin thread changes. If the thread being used for the quilting is heavy weight and the mechanism is run at a low speed, the use of a large bobbin does not cause much of a problem. But when lighter weight threads are used and/or the operator attempts to run the sewing machine at a high speed, thread breakage and undesirable thread looping often occur because the tension on the thread coming from the large bobbin is greater than the tension placed upon the thread coming through the needle. When the top thread coming from the needle has more slack than the bottom thread from the bobbin, a loop is formed by that top thread on the underside of the material during the final tightening of the stitch. Besides being unsightly, the looping of the top thread creates a less than adequate hold or knot with the bobbin thread, allowing the bobbin thread to slip as successive stitches are made, sometimes causing the bobbin thread to break under this added stress. It is, therefore, desirable to have a sewing machine with special material controlling mechanism and thread tensioning mechanism when used to make quilts.

In particular, a material controlling mechanism that is especially advantageous for use with a quilting machine includes a presser foot that reciprocates in coordination with the reciprocating needle, pressing against the materials as the needle makes a stitch, then lifting as the material controlling mechanism is moved to the position of the next stitch.

Many of the quilting machines that use a reciprocating or "hopping" presser foot do not utilize a traditional sewing mechanism to do the quilting. The mechanism used is often large and stationary, having several needles and presser feet and having material to be quilted fed therethrough. Therefore, the hopping feet are often part of a complicated feed bar system.

Other hopping foot mechanisms have been created for use with sewing machines that do not necessarily sew quilted materials. Such mechanisms frequently include intricate and sometimes elaborate arrangements of joints and levers which allow the foot to adjust for different material widths, but are often expensive and require careful maintenance.

Intermittent tension devices have been used in a variety of sewing applications where extra tension is needed. Multi-thread intermittent tension mechanisms are used to embroider fabric, placing tension on certain threads at certain times during the embroidery process in order to sew a desired color of thread. Intermittent tension devices have also been used in sewing heavy materials or materials with a hard finish, such as denim or canvas, so that very heavy tension is applied on the thread at the final tightening of the stitch. However, suitable tension devices have not been provided for quilting mechanisms as described herein so that heavier tension may be placed at the final tightening of the stitch to balance the already heavy tension on the bobbin thread.

In particular, conventional intermittent tension mechanisms commonly function by interraction with an eccentric cam located on a cross drive shaft of the sewing machine. In many of the mechanisms, the thread is held tightly between two disks biased together by a spring. A rod connected to the eccentric cam, reciprocates, pushing at one point in its cycle against the outer tension disk and the spring, relieving tension on the thread. This type of system works well for embroidery where the thread must be held in place until a certain point in the sewing cycle when it is allowed to pass through the mechanism and be used to make a stitch. However, such mechanisms do not work as well in applications wherein it is desirable to apply a certain thread tension until one point in the sewing cycle after which additional tension is required to complete the cycle.

Another problem often encountered with intermittent tension devices is that the reciprocating rod rubs against the eccentric cam. With continuous use, friction between the rod and cam produces wear on both parts, resulting in improper tension and requiring replacement of worn parts. Also, any type of connection between the rod and cam that is left open to the environment is problematic because of lint build up caused by the materials to be sewn. This is particularly a problem with quilting due to the loose consistency of the inner filler material.

SUMMARY OF THE INVENTION

The present invention provides a sewing machine for use with a quilting apparatus. The sewing machine includes a material controlling mechanism and a thread tension controlling mechanism, both utilizing eccentric cams located on the main drive shaft of the sewing machine to motivate the mechanisms.

The material controlling mechanism includes a hopping foot that reciprocates in coordination with a sewing machine needle, pressing down on the material to be sewn when the needle passes through the material and lifting when the needle or material is moved to a new location relative to one another so that the next stitch can be made. The source of the reciprocating movement of the hopping foot is an eccentric cam located on a fly wheel on a main drive shaft of the sewing machine. A sleeve surrounds and slidably rides on the eccentric cam. An arm is pivotally attached to the sleeve at one end and pivotally attached to one end of a rocking bar at the arm's other end. The center of the rocking bar is pivotally mounted on a support structure on a housing of the sewing machine. An opposite end of the rocking bar is slidingly and pivotally attached to a presser foot bar to which the hopping foot is attached. As the arm reciprocates due to the motion of the eccentric cam, the rocking bar rocks, causing the presser foot bar to reciprocate.

The simple construction of the pivotal attachment between the arm and the rocking bar allows the hopping foot to adjust immediately to different material thicknesses. A generally spherical collar is slidably mounted on the arm and connected to the rocking bar. The collar is biased against a stop on the arm by action of a spring located underneath the collar. A ring having a curved interior to receive the spherical collar integral with the rocking bar and captively connects the spherical collar to the rocking bar so that the rocking bar is normally biased upward toward the stop on the arm by the spring, but when the hopping foot engages thick material the rocking bar can bias the spring downward to adjust for the thickness. In particular, when the hopping foot comes into contact with a material thickness greater than what it had been sewing, the ring presses down against the spherical collar, compressing the spring. Thereafter, as the arm moves down lifting the hopping foot off the material, the collar returns to a position biased against the stop.

The thread tension control mechanism is an intermittent tension device which includes an eccentric cam also located on the main drive shaft of the machine. The eccentric cam is surrounded by a sleeve that is slidingly mounted thereon so as to rotate with the cam until coming in contact with a cam follower. Upon contact with the cam follower, the sleeve does not rotate, allowing the cam follower to reciprocate as the drive shaft rotates while placing minimal wear on the non-rotating outer surface of the sleeve.

The cam follower is connected to a pair of tension disks through which the thread passes. A spring exerts pressure on the disks placing a constant first tension on the thread. During a portion of the rotating cycle of the cam, the cam follower is urged outward as to bias one tension disk against the other, thereby producing an increased or second tension on the thread during a portion of the sewing cycle. The timing of the period wherein the second tension is applied coincides with the final tightening of the stitch after which the cam follower then withdraws thereby reducing tension on the thread and returning the tension control mechanism to the configuration producing the first tension in the thread.

OBJECTS OF THE INVENTION

Therefore, the objects of the present invention are: to provide an improved sewing machine adapted for use in quilting, including an improved material control mechanism and a thread tension control mechanism; to provide such a machine wherein the material control mechanism is of relatively simple construction and able to hold the material to be sewed in place while a stitch is being made and to reciprocate so that a needle of the sewing machine may easily move to the site of the next stitch; to provide such a control mechanism that is relatively easy to adjust to different material thicknesses; to provide such a thread tension control mechanism that is of simple construction and able to increase tension on the thread at the final tightening of the quilting stitch in order to equalize the tension placed on the thread from the needle to that of the thread from the bobbin while reducing wear on parts thereof; and to provide such improvements to a sewing machine that are relatively inexpensive to make, easy to use and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is an enlarged, fragmentary and cross-sectional view of the sewing machine showing a cam of the intermittent tension mechanism wherein same is in a thread advancing configuration, taken along line 5—5 of FIG. 3.

FIG. 6 is an enlarged, fragmentary and cross-sectional view of the sewing machine showing the tension mechanism cam in a thread clamping configuration, taken along line 5—5 of FIG. 3.

FIG. 7 is an enlarged exploded view of the sewing machine intermittent tension machine.

FIG. 8 is an enlarged and fragmentary front elevational view of the sewing machine with portions thereof broken away to show detail of an upper portion of the hopping foot mechanism.

FIG. 9 is an enlarged and fragmentary cross-sectional view of the sewing machine hopping foot mechanism, taken along line 9—9 of FIG. 8, showing in solid lines a first position of portions of the hopping foot mechanism and showing in phantom lines a second position of the same portions of the hopping presser foot mechanism.

FIG. 10 is an enlarged and fragmentary side elevational view of the sewing machine showing the hopping foot mechanism, including in solid lines a hopping foot in a lowered first portion and in phantom lines the hopping foot in a raised second position, engaging relatively thin material.

FIG. 11 is an enlarged and fragmentary side elevational view of the sewing machine hopping foot mechanism engaging relatively thick material.

FIG. 12 is an enlarged and fragmentary cross-sectional view of the sewing machine hopping foot mechanism, taken along line 12—12 of FIG. 10.

FIG. 13 is an enlarged and fragmentary cross-sectional view of the sewing machine hopping foot mechanism.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
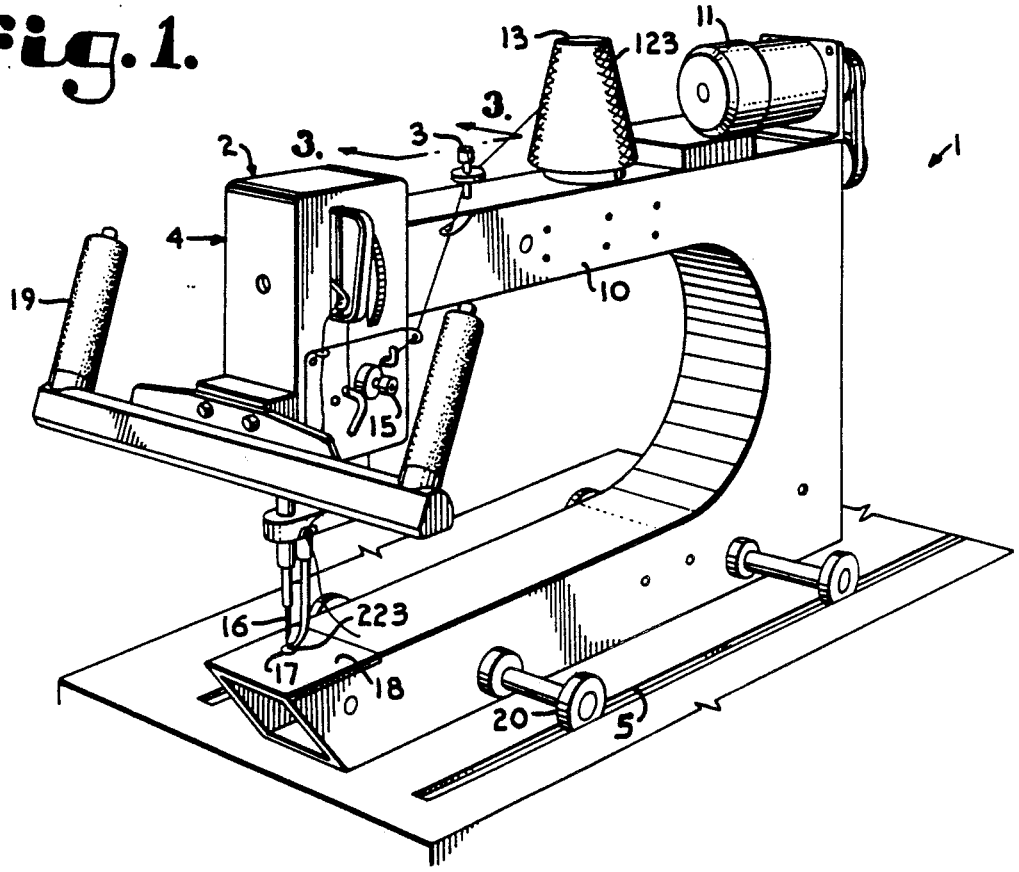
FIG. 1 is a perspective view of the sewing machine for quilting having an improved intermittent tension control mechanism and a hopping foot mechanism.
Figure 2:
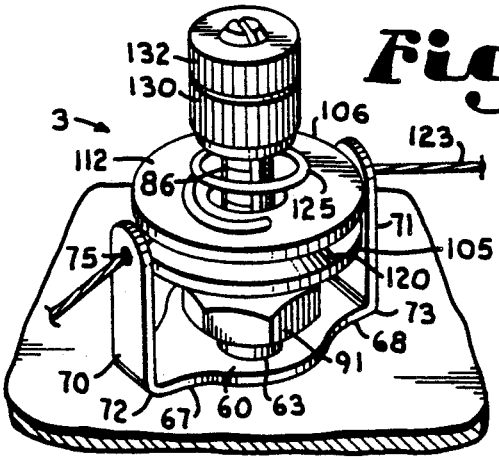
FIG. 2 is an enlarged and fragmentary perspective view of the sewing machine showing the intermittent tension device.
Figure 3:
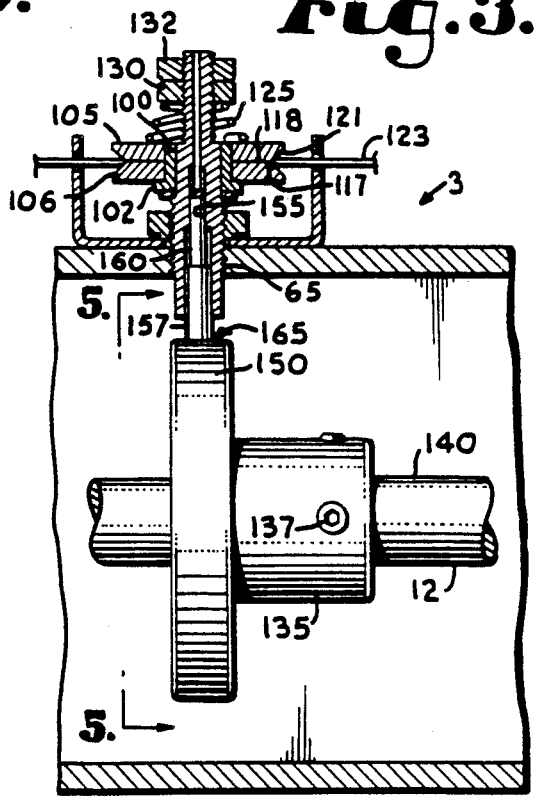
FIG. 3 is an enlarged and fragmentary cross-sectional view of the sewing machine taken along line 3—3 of FIG. 1 showing the intermittent t tension mechanism and an eccentric cam thereof located on the main shaft.
Figure 4:
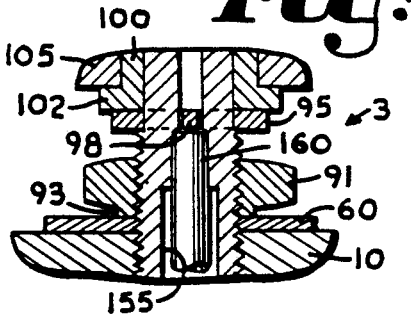
FIG. 4 is an enlarged and fragmentary cross-sectional view of the sewing machine intermittent tension mechanism, showing a portion of the view of FIG. 3.

FIGS. 1 through 12 generally illustrate a quilting apparatus in accordance with the present invention, generally designated by the reference numeral 1 and including a sewing machine 2 having improved intermittent tension control means or mechanism 3 and improved hopping foot control means or mechanism 4. In FIG. 1, the sewing machine 2 is shown rollingly mounted on a pair of rails or tracks 5 of a quilting frame (not shown). The sewing machine 2 includes a housing 10, main drive means such as illustrated electric motor 11 that operably rotates a main drive shaft 12, a spool holder 13, the intermittent thread tensioning mechanism 3, a second thread tension mechanism 15, a reciprocating needle 16, the hopping foot control mechanism 4 including a hopping presser foot 17, a throat plate 18, a hand-held machine guide 19 and track wheels 20. The intermitent thread tension control mechanism 3, extends outward from the top of the housing 10 and is located between the spool holder 13 and the thread tension mechanism 15. It is noted that it is possible to place the intermittent tension control mechanism 3 in other positions and locations than that shown.

Referring to FIGS. 2 through 7, the intermittent thread tension control mechanism 3 includes a flat, circular clamp plate 60, having an axial circular bore 63 thereby, resting on the housing 10, above a tapped, circular aperture 65 therein approximately the same size as the bore 63. Two arms 67 and 68 extend horizontally, outwardly from the clamp plate 60, each bending upward to form ears 70 and 71 aligned perpendicular to the housing 10 at bends 72 and 73 respectively. Thread guide apertures 75 and 76 respectively are located near the distal ends of the ears 70 and 71.

A tube 80 has an outer diameter slightly smaller than the bore 63 and housing aperture 65 and is mounted in the housing aperture 65 such that one end 82 of the tube 80 extends into the housing 10. The tube 80, is diagonally slit throughout the greater part of its length to provide a slot 84, and has a threaded end portion 86 having an outer diameter slightly less than that of the rest of the tube 80. The tube 80, also contains a threaded portion 89 located near a base 90 of the slot 84, and extending toward end 82. The threaded portion 89 of the tube 80 threadedly fitting into the tapped aperture 65. A locking nut 91 has a shoulder 93, and is located on the threaded portion 89. The nut 91 abuts the clamp plate 60 at the shoulder 93 and secures the tube 80 and clamp plate 60 in a fixed, but adjustable position on the sewing machine housing 10.

A relatively flat abutment ring 95 has a central and diagonally extending pin abutment member or bar 98. The bar 98 is axially slidingly mounted on the tube 80 with the bar 98 positioned in and slidable along the slot 84. A spacer 100, slidingly mounted on the tube 80 and having a flange 102, contacts the abutment ring at a flanged end 103 thereof. The outer diameter of the flange 102, is slightly larger than the outer diameter of the abutment ring 95.

Two substantially identical tension disks 105 and 106 have bores 108 and 109 respectively at the center thereof. The diameters of the bores 108 and 109 are being slightly larger than the outer diameter of the spacer 100. The disks 105 and 106 are slidingly mounted on the spacer 100 on the tube 80. Each tension disk 105 and 106 has a flat surface 111 and 112 respectively on one side thereof. An opposite surface 114 and 115 respectively of each of the disks 105 and 106 are dish shaped with a flat central portion 117 and 118 respectively and a textured angled surface 120 and 121 respectively that tapers toward the periphery of the respective disk. The flat surface 111 of the first tension disk 105 rests on the flange 102 of the spacer 100. The surfaces 117 and 118 abut with the angled surfaces 120 and 121 forming a channel or groove upon which an operator may easily place a length of thread 123 when initially threading the sewing machine 2. The surfaces 120 and 121 are textured or ribbed to help keep the thread 123 inbetween the disks 105 and 106 when the thread 123 is slack.

A helical and conically shaped spring 125 contacts the flat surface 112 of the tension disk 106 and is wound around the tube 80 near the threaded end portion 86. A small end 127 of the spring 125 bears against a pressure adjustment fastener 130 threaded upon the end portion 86 that allows manual adjustment of the tension placed upon the thread 123 passing inbetween the tension disks 105 and 106. A locking fastener 132 also threaded upon the end portion 86 is positioned to abut the adjustment fastener 130 and hold the adjustment fastener 130 in a selected position.

An eccentric cam 135, secured by set screws 137, to the main drive shaft 12 is rotated by the drive motor 11 and is cooperatively connected to the tension disks 105 and 106 to control tension on the thread 123.

The radially outer surface of the eccentric cam 135 is surrounded by and fixedly attached to an inner sleeve 143. An inner surface of a middle sleeve 147 surrounds a radially outer surface of the inner sleeve 143 and is rotatable about the inner sleeve 143. An inner surface of an outer sleeve 150 is fixedly attached to a radially outer surface of the middle 147.

A rod-shaped cam follower 154 has a first section 157 with a first end 158 and a second section 160 of smaller diameter than the first section 157, thereby creating a shoulder 161. The second section 160 has a second end 162. The first end 158 abuts against the outer sleeve 150 in the location represented by the numeral 165 as the cam 135 operably rotates with the drive shaft 12. The outer sleeve 150 rotates until it comes in contact with end 158 and then does not substantially rotate but reciprocates up and down depending upon the eccentric position of the body of the cam 135 until loosing contact with end 158 on the downward stroke.

The cam follower 154 is of smaller diameter than the tube 80 and extends in a vertical direction through the open end 82 of the tube 80 into an axial bore 155 of the tube 80. The inner diameter of the tube bore 155 is configured such that an outer surface of the first section 157 is positioned in the bore 155 and slides along the inner surface of the bore 155. The inner diameter of the bore 155 narrows approximately halfway between the cam follower shoulder 161 and second end 162, so as to slidingly fit around the second section 160, keeping the cam follower 154 in vertical allignment, but allowing it to freely reciprocate vertically within the tube 80. The second end 162 abuts against the center bar 98 of the abutment ring 95. The spring 125 operably biases the cam follower 154 against both the cam outer sleeve 150 and the abutment ring center bar 98.

In operation, the rotation of the main drive shaft 12, causes the eccentric cam 135 to rotate, causing the cam outer sleeve 150 to rotate and reciprocate up and down and subsequently to cause the cam follower 154 to reciprocate upon coming in contact with the outer sleeve 150. As the cam follower 154 moves upward, or in the direction of the tension disks 105 and 106, the follower second end 162 pushes against the slidingly mounted abutment ring 95 to urge the ring upward against the disk 105 and thereby place increased pressure on the interface between the first and second tension disks 105 and 106, while also pressing the disks 105 and 106 against the spring 125. The thread 123 is positioned at the interface between the disk 105 and 106 and is held relatively more securely thereby due to the increased pressure.

At the peak of the cam follower's reciprocation, see FIG. 6, the pressure on the tension disks 105 and 106 is such that the thread 123 passing therebetween is clamped, halting advancement of the thread 123 through the sewing needle 16. The timing when the thread 123 is clamped corresponds to the critical final tightening of the stitch, creating tension on the thread 123 at the needle 16 equivalent to that already on an opposed bobbin thread, resulting in an even stitch. As the cam follower 154 is moving downward due to further rotation of the cam 135, see FIG. 5, thereby reducing the pressure on the abutment ring 95, the pressure on the thread 123 is reduced and subsequently returns to a tension that allows the thread 123 to advance without breaking to create the next stitch.

The hopping presser foot 17 is part of and controlled by the foot hopping foot control mechanism 4 and is best illustrated in FIGS. 8 through 12. As with the intermittent tensioning mechanism 3, the reciprocating movement of the hopping presser foot 17, generally is controlled by an eccentric cam 173, located on a fly wheel 175 mounted on the main drive shaft 12. It is foreseen that the eccentric cam 173 may be located on the main drive shaft 12 separate from the fly wheel 175. A sleeve 178 that does not rotate with the cam 173 encircles the cam 173 and reciprocates. A support member 181, integral with and depending from the sleeve 178, extends vertically downward from said sleeve 178 and has a bore 183 therethrough. A pin 185 is mounted in the bore 183 and also through a bore 188 in an upper arm 190, so as to pivotally connect the support member 181 to the upper arm 190. A spherical collar 195 is slidingly attached to the upper arm 190 inbetween a fixed upper collar stop 198 and a slidingly attached lower collar stop 202. A compression spring 205, located below the lower collar 202, is sleeved around a lower portion of the upper arm 190 and rests against a fixed end member 208, located near a lower distal end of the upper arm 190. The spring 205 is biased against the lower collar 202 and biases the spherical collar 195 against the stop 198.

Encircling the spherical collar 195 is a race or ring 212 that is integral by attachment to a rocking bar 215. The collar 195 and ring 212 form a ball joint. The center of the rocking bar 215, pivots on a rock shaft 218, mounted upon a support structure 221 of the housing 10. The rocking bar 215 is slidably connected to a pivot member 223 at an end 225 opposite the ring 212 by a pin 226 fixedly connected to the pivot member 223. The pin 226 slides within an aperture 227 located within the rocking bar 215, extending from near the rock shaft 218 to end 225. A pin 228 passes through the pivot member 223 and a presser bar support 230, pivotally connects the rocking bar 215 with a hopping presser bar 231. The hopping presser foot 17, is integral by attachment to the hopping presser bar 231 and has a lower horizontally aligned aperture 233 through which the needle 16 passes.

During sewing, the rotation of the main drive shaft 12, causes the fly wheel 175 and eccentric cam 173 to rotate, causing the upper arm 190 to reciprocate along a vertical axis, thereby causing the rocking bar 215 to rock and the hopping presser bar 231 to reciprocate. As the rocking bar 215 rocks, the pin 226 slides within the aperture 227. The reciprocating movement of the hopping presser bar 231 is in coordination with the reciprocating movement of the needle 16, so that the foot 17 presses down on material 240 to be stitched as the needle 16, pierces the material 240 and lifts from the material after the needle 16 passes back up through the material upon completion of a stitch.

When the sewing mechanism 1, encounters thick material 241 (see FIG. 11), the hopping foot control mechanism 4, automatically adjusts for the thickness. Under normal conditions, as the upper arm 190, moves upwardly, pressing the hopping foot 17 onto the material 240, the ring 212, pivots freely on the spherical collar 195 that is held against the stop 198 held by the action of the spring 205 (see FIG. 10). As the presser foot 17 comes into contact with thicker material 241, the rocking movement of the rocking arm 215, is limited so that as the upper arm 190 travels upwardly, the ring 212 presses down upon the spherical collar 195, forcing it to slide along the arm 190 and compress the spring 205 (see FIG. 11). As the upper arm 190, begins its downward movement, the spherical collar 195, returns to its original position, in readiness for the next stitch.

It is to be understood that while certain forms of the present invention have been illustrated and described herein, it is not to be limited to the specific forms or arrangement of parts described and shown.

What is claimed and desired to be secured by Letters Patent is as follows:

1. In a sewing machine for a quilting apparatus including a housing, motor means for operably driving the machine, a main drive shaft operably rotated by the motor means, a needle operably reciprocated by the motor means, and a presser foot, the improvement comprising:

(a) first eccentric cam means for controlling advancement of a thread through the machine and located on and rotated by the main drive shaft;

(b) a first sleeve slidably mounted on a radially outer surface of said cam means so as to reciprocate with said cam means;

(c) a cam follower adapted to abut a radially outer surface of said first sleeve;

(d) tension means for applying tension to the thread and operably cooperating with said cam follower and adapted to halt the advancement of thread at the end of each sewing cycle associated with said machine during operation due to the reciprocating motion of said cam follower cooperatively acting upon said tension means;

(e) second cam means for operably controlling reciprocation of the presser foot;

(f) a reciprocating arm cooperating with said second cam means so as to reciprocate along an axis during operation of said machine;

(g) a collar slidably sleeved on said reciprocating arm;

(h) a rocking bar pivotally connected to the housing; said rocking bar having ring means at one end thereof; said ring means pivotally connected to said collar so as to allow movement of said collar along said arm; and (i) said presser foot being pivotally and slidingly connected to said rocking bar.

2. The machine of claim 1, wherein said tension means includes:

(a) first and second tension disks mounted on the housing; said first disk facing opposingly to said second disk forming a frictional interface therebetween for the thread to pass through; said cam follower axially passing through and being adjacent to at least one of said first and second tension disks and urging said disks toward one another upon axial movement of said cam follower toward said disks;

(b) said cam follower engaging a surface of said first sleeve such that said first sleeve surface is prevented from rotating when said cam follower reciprocates with said cam means; and (c) a first spring biasing said first disk toward said second disk so as to apply tension to the thread passing therethrough when said cam follower presses against said first and second disks in opposition to said spring.

3. The machine of claim 1 including:

(a) a non-rotating second sleeve encircling said second cam means and pivotally connected to said reciprocating arm.

4. The machine of claim 1 including:

(a) a collar stop fixedly positioned on said reciprocating arm; and (b) said collar being a spherical collar; biasing means adapted to urge said spherical collar toward said stop; whereby, when said presser foot engages relatively thin material, said spherical collar is biased against said stop, but, when said presser foot engages relatively thick material, said foot through said rocking bar biases said spherical collar away from said stop to allow adjustment for thickness.

5. In a sewing machine for a quilting apparatus including a housing, a main drive shaft operably rotated by motor means, a needle operably reciprocated by the motor means, the improvement comprising:

(a) an eccentric cam located on the main drive shaft;

(b) a sleeve slidingly mounted upon and surrounding said eccentric cam;

(c) a cam follower abutting said sleeve so as to be reciprocately driven by rotation of said cam, said cam follower generally engaging said sleeve without substantially sliding therealong; and (d) tension means cooperating with said cam follower; said tension means halting the advancement of thread at the end of each sewing cycle due to the reciprocating motion of said cam follower.

6. The machine according to claim 5, wherein said tension means includes:

(a) first and second tension disks mounted on the housing, said first disk facing opposingly to said second disk forming a channel for a thread to pass through, said cam follower engaging said first and second tension disks; and (b) a spring biasing said first disk toward said second disk so as to clamp the thread passing therethrough as said cam follower exerts pressure upon said first and second disks.

7. In a sewing machine for a quilting apparatus including a housing, a main drive shaft operably rotated by motor means and a reciprocating needle, the improvement comprising:

(a) an eccentric cam located on the main drive shaft and operably rotated by said drive shaft;

(b) a reciprocating arm connected to and cooperating with said eccentric cam so as to reciprocate along an axis of said arm as said cam rotates;

(c) a collar slidably mounted on said arm;

(d) a rocking bar medially and pivotally connected to said housing; said rocking bar having a collar engaging member at one end thereof; said member pivotally connected to collar; and (e) a presser foot slidingly and pivotally connected to said rocking bar.

8. The machine according to claim 7, including:

(a) a non-rotating sleeve encircling said eccentric cam and pivotally connected to said reciprocating arm.

9. The machine according to claim 7 including:

(a) a stop located above said collar on said reciprocating arm;

(b) a spring located beneath said collar, biasing said collar toward said stop such that when said presser foot engages relatively thin material said collar is urged against said stop, but when said presser foot engages relatively thick material said collar is biased by said foot acting through said rocking bar to bias against said spring and become spaced from said stop.

10. In a sewing machine for a quilting apparatus including a housing, a main drive shaft operably driven by motor means and a reciprocating needle, the improvement comprising:

(a) a first eccentric cam rotated by said motor means and located on the main drive shaft, said eccentric cam having an outer first sleeve slidingly attached thereto;

(b) a cam follower adapted to abut said first sleeve, so as to place said cam follower in reciprocating motion when the drive shaft rotates;

(c) first and second tension disks mounted on the housing, said first disk facing opposingly to said second disk forming a passage for a thread to pass through, said cam follower being in contact with at least one of said first and second tension disks; and (d) a first spring biasing said first disk toward said second disk so as to clamp the thread passing therethrough when said cam follower exerts pressure upon said first and second disks compressing said first spring;

(e) a fly wheel located on the main drive shaft;

(f) a second eccentric cam connected to said drive shaft;

(g) a non-rotating second sleeve surrounding said second eccentric cam;

(h) an arm pivotally attached to said second sleeve such that said arm is placed in reciprocating motion when the drive shaft rotates;

(i) a spherical collar slidingly mounted on said arm;

(j) a stop mounted on said arm;

(k) a second spring biasing said spherical collar toward said stop;

(l) a ring encircling said spherical collar so as to form a pivotal ball and socket joint;

(m) a rocking arm integral with said ring; said rocking arm pivotally mounted medially therealong on the housing; and (n) a presser foot slidingly and pivotally connected to said rocking arm.

11. In a sewing machine for a quilting apparatus including a housing, a main drive shaft operably driven by motor means and a reciprocating needle, the improvement comprising:

(a) an eccentric cam located on the main drive shaft and rotated by said motor means; said eccentric cam having an outer sleeve slidingly mounted thereto and adapted to reciprocate with said cam;

(b) a cam follower adapted to abut and thereby prevent rotation of said outer sleeve, such that said cam follower is placed in reciprocating motion when the drive shaft rotates;

(c) first and second tension disks mounted on the housing; said first disk facing opposingly to said second disk forming a passage for a thread to pass through; said cam follower connected to at least one of said first and second tension disks; and (d) spring means biasing said first disk toward said second disk so as to clamp the thread passing therethrough when said cam follower exerts pressure upon said first and second disks.

12. In a sewing machine for a quilting apparatus including a housing, a main drive shaft operably rotated by motor means and a reciprocating needle, the improvement comprising:

(a) an eccentric cam located on said drive shaft and operably rotated by said motor means;

(b) a non-rotating sleeve surrounding said cam;

(c) an arm pivotally attached to said sleeve, such that said arm is placed in reciprocating motion when the drive shaft rotates;

(d) a collar slidingly mounted on said arm;

(e) a stop mounted on said arm;

(f) biasing means operably urging said collar toward said stop;

(g) a member connected to said collar;

(h) a rocking arm attached to said member; said rocking arm pivotally mounted on the housing; and (i) a presser foot slidingly and pivotally connected to said rocking arm.

13. In a sewing machine for a quilting apparatus including a housing, a main drive shaft operably rotated by motor means, spool holding means, a constant thread tension mechanism and a reciprocating needle, the improvement comprising:

(a) a first eccentric cam located on the main drive shaft and operably rotated by said motor means;

(b) a first sleeve encircling said first eccentric cam;

(c) a cam follower adapted to abut said first sleeve, such that said cam follower operably being placed in reciprocating motion when the drive shaft rotates;

(d) a tube mounted on the housing inbetween the spool holding means and the constant thread tension mechanism; said tube having an inner surface, an outer surface and a slot; said cam follower axially and slidably extending through a portion of said tube;

(e) an abuttment ring slidingly mounted on said outer surface of said tube; said abuttment ring having a center bar located in said tube slot; said cam follower having one end abutting said center bar;

(f) first and second tension disks mounted on said tube and engaging said abutment ring; said first disk facing opposingly to said second disk forming an interface for a thread to pass through;

(g) a first spring engaging said second tension disk and biasing said first disk toward said second disk so as to clamp the thread passing therethrough when said reciprocating cam follower presses upon said center bar, exerting pressure upon said first and second disks;

(h) a second eccentric cam located on said main shaft and operably rotated by said motor means;

(i) a non-rotating second sleeve encircling said second eccentric cam;

(j) an arm pivotally attached to said second sleeve, such that said arm is placed in reciprocating motion when said drive shaft rotates; said arm having a lower end;

(k) an upper adjustable stop centrally mounted upon said arm;

(l) a lower stop mounted upon said arm at said lower end;

(m) a sliding collar mounted on said arm between said stops;

(n) a second spring mounted on said arm and located between said lower stop and said sliding collar;

(o) a ring member encircling said sliding collar;

(p) a rocking bar integral with said ring member; said rocking bar pivotally mounted to the housing at a medial location along said bar;

(q) a presser bar slidingly and pivotally connected to said rocking bar; and (r) a presser foot integral with said presser bar.

* * * * *